US011260547B1

(12) United States Patent
Williams

(10) Patent No.: US 11,260,547 B1
(45) Date of Patent: Mar. 1, 2022

(54) ELECTRIC UTILITY KNIFE

(71) Applicant: D'Andra Shekem Williams, Missouri City, TX (US)

(72) Inventor: D'Andra Shekem Williams, Missouri City, TX (US)

( * ) Notice: Subject to any disclaimer, the term of this patent is extended or adjusted under 35 U.S.C. 154(b) by 119 days.

(21) Appl. No.: 16/431,366

(22) Filed: Jun. 4, 2019

Related U.S. Application Data

(60) Provisional application No. 62/680,788, filed on Jun. 5, 2018.

(51) Int. Cl.

| | |
|---|---|
| ***B26B 7/00*** | (2006.01) |
| ***B26B 5/00*** | (2006.01) |
| ***B26B 29/02*** | (2006.01) |
| ***B25F 5/02*** | (2006.01) |
| ***B26B 25/00*** | (2006.01) |

(52) U.S. Cl.
CPC ..... *B26B 7/00* (2013.01); *B26B 5/00* (2013.01); *B26B 29/025* (2013.01); *B25F 5/029* (2013.01); *B26B 25/002* (2013.01)

(58) Field of Classification Search
CPC ..... B26B 7/00; B26B 5/00; B26B 29/025; B26B 25/002; B26B 7/005; B26B 25/00; B26B 25/005; B26B 25/007; B25F 5/029; B23D 57/0076; B23D 49/16; B23D 49/007; B23D 51/025; B23D 51/08; B23D 51/16; F16H 25/12; Y10T 74/18312; B27B 19/00; B27B 19/002; B27B 19/006
See application file for complete search history.

(56) References Cited

U.S. PATENT DOCUMENTS

| | | | | |
|---|---|---|---|---|
| 1,679,884 | A * | 8/1928 | Thomas | B23D 51/16 74/60 |
| 3,487,319 | A * | 12/1969 | Robison | H01M 50/213 320/114 |
| 3,606,216 | A * | 9/1971 | Chambers | H02K 7/145 248/37.3 |
| 4,139,760 | A * | 2/1979 | Banks | A47G 21/02 219/227 |
| 4,901,588 | A * | 2/1990 | Zudal | B23D 57/0076 74/57 |
| 5,427,188 | A * | 6/1995 | Fisher | B25D 11/102 173/205 |
| 5,607,265 | A * | 3/1997 | Lane | B23D 51/16 144/35.2 |
| 7,077,736 | B2 * | 7/2006 | Uzumcu | B23D 47/126 451/358 |
| 7,165,920 | B2 * | 1/2007 | Baber | B23C 1/20 144/117.3 |

(Continued)

*Primary Examiner* — Jonathan G Riley
(74) *Attorney, Agent, or Firm* — D'Ambrosio & Menon, PLLC; Usha Menon

(57) ABSTRACT

An electric utility knife having a blade which can facilitate manual precision cutting, at a singular consistent speed or varying speeds, without requiring the user to exert extreme or substantial manual pressure to cut through a material. The blade can be configured as a vibrating/oscillating/rotating blade to perform a majority of the cutting tasks. The user may simply guide the blade and exert minimal manual pressure on the knife. This can reduce the potential for injury and other repetitive motion stress injuries to a user. This can also facilitate greater cutting precision and can reduce cutting time.

14 Claims, 11 Drawing Sheets

(56) References Cited

U.S. PATENT DOCUMENTS

| | | | | |
|---|---|---|---|---|
| 7,536,793 | B1 * | 5/2009 | Richmond | A47G 21/14<br>211/70.7 |
| 9,877,741 | B2 * | 1/2018 | Levy | A61B 17/320068 |
| 2010/0095534 | A1 * | 4/2010 | Saiz | B26B 7/00<br>30/272.1 |
| 2010/0199501 | A1 * | 8/2010 | Hernandez | B26B 7/00<br>30/162 |
| 2018/0186018 | A1 * | 7/2018 | Peyrot | B26B 5/001 |
| 2018/0186019 | A1 * | 7/2018 | Fieil | B26B 9/02 |

* cited by examiner

ELECTRIC UTILITY KNIFE

CROSS REFERENCE TO RELATED APPLICATION

This application claims the benefit of Provisional U.S. Patent Application No. 62/680,788, filed Jun. 5, 2018, the entire content and disclosure of which, both express and implied, is incorporated herein by reference.

FIELD OF INVENTION

The present invention relates generally to a cutting tool. In particular, the invention relates to an electric utility knife.

BACKGROUND

Background description includes information that may be useful in understanding the present invention. It is not an admission that any of the information provided herein is prior art or relevant to the presently claimed invention, or that any publication specifically or implicitly referenced is prior art.

Industrial workers prefer to use utility knives to razor blades and scissors as cutting tools. Unlike razor blades and scissors, utility knives are inherently safer and easier for cutting shipping materials, boxes, and more. Scrapbookers prefer to use craft or hobby knives to razor blades and scissors as cutting tools. Unlike razor blades and scissors which can be used to make straight cuts, hobby knives can be used to cut and create patterns, circles and intricate designs. A hobby knife is an improvised utility knife that allows the user to apply manual force to precisely cut and carve materials, such as, paper or fabric, or cut precise line and curves using compression. A utility knife allows users to apply manual force to cut materials in either an imprecise or precise manner. Utility knives are also safer to use and handle in comparison to razor blades and scissors. Utility knives have been in existence for centuries.

The use of conventional cutting tools, including utility knives, requires the application of direct manual pressure and impact to effect cutting. A substantial amount of pressure is required to effect precise cutting of materials that are not easily yielding. The exertion of such a substantial amount of manual pressure, often pinpointed near the end of the knife shaft or the tip of the blade, can result in skin, muscle or bleeding injuries, especially with extreme pressure exertion or prolonged use. Repetitive use, and sometimes even infrequent or singular use, of these conventional cutting tools can become physically detrimental to the user. Some users can develop physical symptoms associated with strenuous singular use or regular use, or overuse. The symptoms can include symptoms similar to writer's bump, writer's cramp, repetitive motion syndrome, carpal tunnel syndrome, as well as undue callouses, bruises, cuts and other wounds.

SUMMARY

There is a need for a device that can overcome the defects of conventional cutting tools by substantially reducing the amount of manual force needed for cutting a material. Preferably, such a device is electrically powered.

The one or more embodiments of the invention disclose a motorized electric utility knife. As used herein, the term "utility knife" includes, without limitation, a cutting tool, such as, a knife, a hobby knife, a craft knife and a utility knife.

The electric utility knife disclosed herein is a compact, lightweight and ergonomic device. The terms "electric utility knife" and "knife" are used interchangeably hereinafter. The knife can be configured to cut a variety of materials with or without vibration/oscillation/rotation. The knife can be configured to operate at a singular consistent speed or varying speeds for users that require precise compression cutting ability beyond what is capable with traditional non-motorized utility knives that require application of significantly more manual force.

According to an embodiment, an electric utility knife includes: an elongate shaft, the shaft configured to be hand-held during a cutting operation, the shaft comprising an internal cavity; a motor assembly, wherein at least a portion of the motor assembly is positioned within the cavity; a blade base in mechanical engagement with the motor assembly; and a blade coupled to a first face of the blade base. The shaft is substantially cylindrical. The knife includes a removable power source, such as, a battery. The power source is disposed within the cavity. The base includes a housing and at least one chamber formed within inside sidewalls of the housing. At least one pair of flanges can be formed within the at least one chamber. The knife further includes a cover for enclosing one end of the shaft. One end of the motor assembly terminates in a tip. The tip is enclosed within the at least one pair of flanges formed inside the sidewalls of the base housing. The power source is configured to transfer a range of motions to the blade. The range of motions is selected from the group consisting of oscillation, vibration, rotation and combinations thereof. The motor assembly further comprises a power button. The power button configured to switch the electric utility knife between an ON and OFF state. According to an embodiment, the knife further comprises a safety cover for the blade.

According to another embodiment, a method for cutting a material without exertion of substantial manual pressure involves: providing an electric utility knife, comprising: an elongate shaft, the shaft configured to be hand-held during a cutting operation, the shaft comprising an internal cavity; a motor assembly, wherein at least a portion of the motor assembly is positioned within the cavity; a blade base in mechanical engagement with the motor assembly; and a blade coupled to a first face of the blade base. The method further involves inserting a power source inside the shaft. This can be followed by gripping the electric utility knife by the shaft. The power source can be switched to an ON state and the blade can be guided to cut the material. The electric utility knife is configured to facilitate manual precision cutting at either a singular consistent speed or at variable speeds. The electric utility knife is configured to provide a range of motions selected from the group consisting of vibration, oscillation, rotation and combinations thereof.

According to another embodiment, an electric utility knife kit includes: a cordless electric utility knife, the electric utility knife comprising: an elongate shaft, the shaft configured to be hand-held during a cutting operation, the shaft comprising an internal cavity; a motor assembly, wherein at least a portion of the motor assembly is positioned within the cavity; and a blade base in mechanical engagement with the motor assembly; and one or more blades, the blades configured to be coupled to a first face of the blade base.

BRIEF DESCRIPTION OF THE FIGURES

The following drawings form part of the present specification and are included to further illustrate aspects of the present disclosure. The disclosure may be better understood by reference to the drawings in combination with the detailed description of the specific embodiments presented herein.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure.

Depending on the context, all references below to the "invention" may in some cases refer to certain specific embodiments only. In other cases it will be recognized that references to the "invention" will refer to subject matter recited in one or more, but not necessarily all, of the claims.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The one or more embodiments of the invention disclose an electric powered knife with a plurality of blade styles. The knife can be configured to facilitate manual precision cutting, at a singular consistent speed or varying speeds, without requiring the user to exert extreme or substantial manual pressure to cut through a material. The blade can be configured as a vibrating/oscillating/rotating blade to perform a majority of the cutting tasks. The user may simply guide the blade and exert minimal manual pressure on the knife. The ergonomic design can reduce the potential for injury, wrist fatigue and other repetitive motion stress injuries to a user. This can also facilitate greater cutting precision and can reduce cutting time.

Figure 1A:
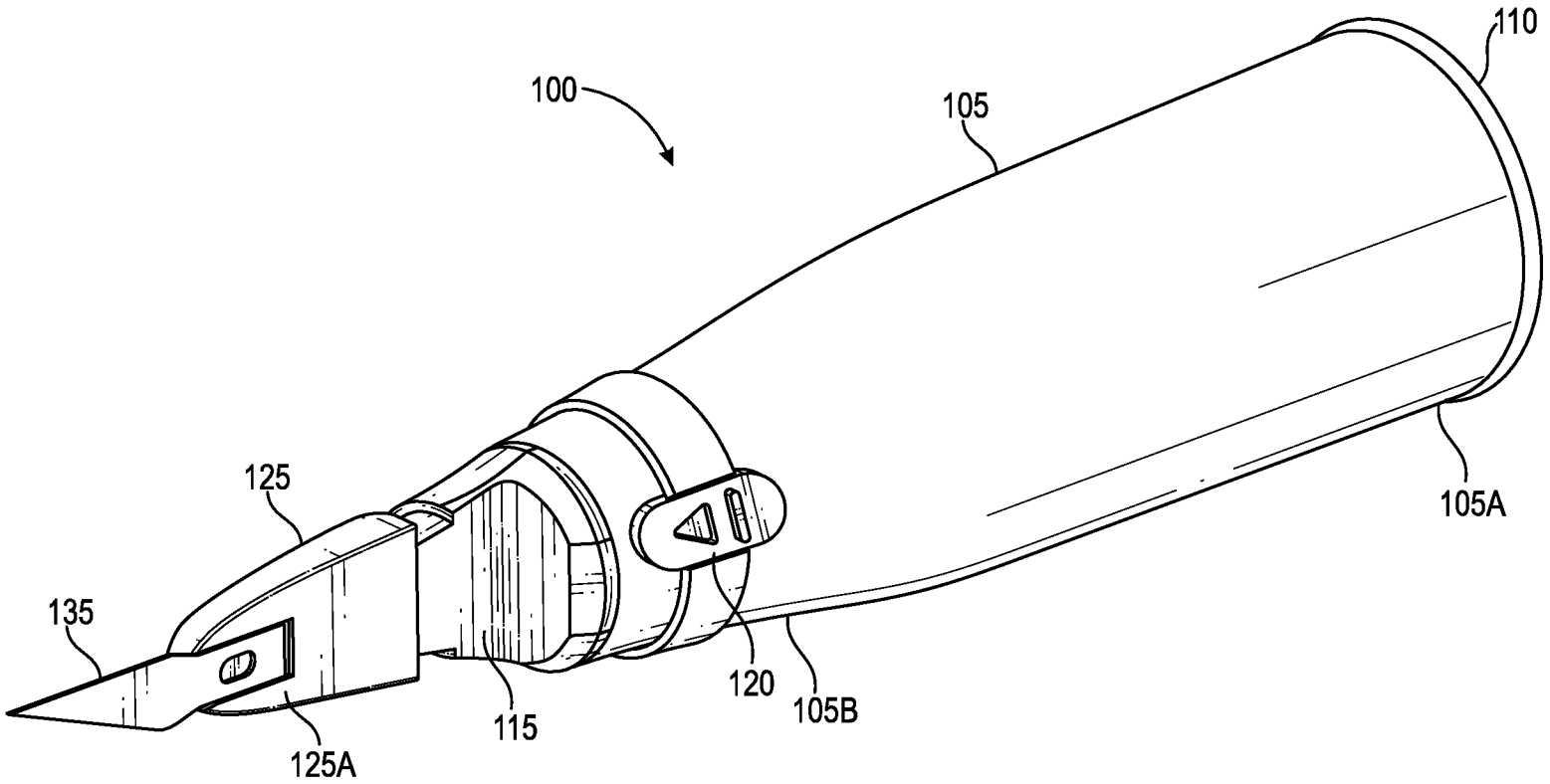
FIGS. 1A and 1B illustrate two views of an electric utility knife according to an embodiment of the invention.
Figure 1B:
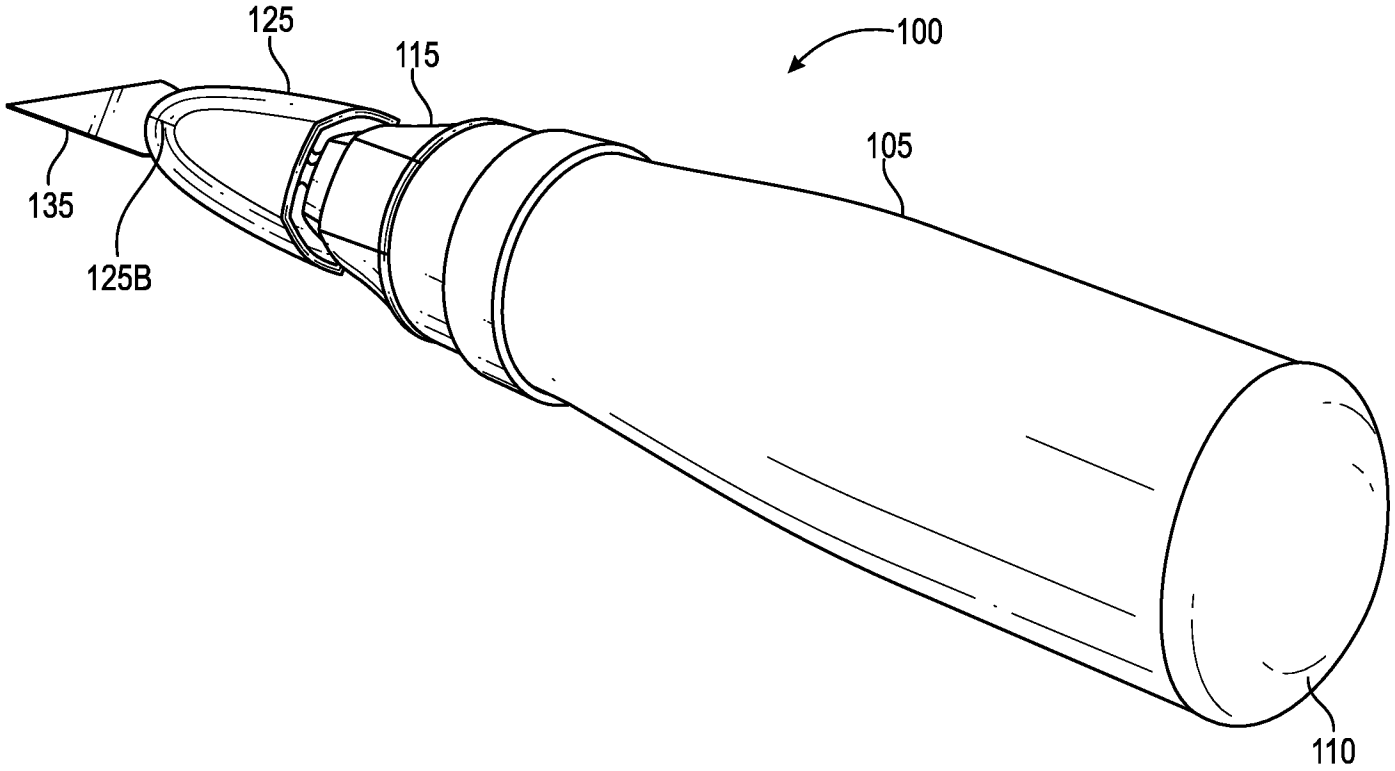

FIGS. 1A and 1B depict two perspective views of an embodiment of the knife. As shown, the knife 100 includes an elongate shaft 105. The shaft 105 can be substantially cylindrical in shape. The shaft 105 includes a hollow internal cavity (not shown). The shaft 105 is configured to be hand-held during a cutting operation. The shaft 105 can be configured to taper from a first end 105A to a second end 105B (or vice versa), wherein the first end 105A is opposite the first end 105A.

In one or more embodiments, the sidewalls of the shaft 105 can include a depression (not shown) that extends inwards. This can facilitate a convenient grip by a user of the knife 100. In other embodiments, the sidewalls can be configured without any such depression. The shaft 105 can include a plurality of ridges, grooves or a textured surface (not shown) to facilitate a better and more ergonomic non-slip grip surface. In certain embodiments, rubber-like, rubberized or silicon grips are provided on the shaft to facilitate a better and more ergonomic non-slip surface.

The shaft 105 is configured to enclose a power source (not shown), such as, a battery inside the cavity. The shaft 105 can be provided with a cover 110. The cover 110 encloses the shaft proximal to the first end 105A. The cover 110 is configured to be removable to facilitate placement or replacement of the battery inside the cavity.

The knife further includes a motor assembly 115. The cavity of the shaft 105 is configured to receive at least a first end of the motor assembly 115. The motor assembly 115 can be configured with a power button 120.

The knife further comprises a blade base 125. The base 125 comprises a housing 125A. At least one chamber (hidden from view) is formed within the inside sidewalls of the housing 125A. A portion of the motor assembly 115 is configured to be received within the chamber such that it is mechanically engaged with the base 125. One or more gears, pistons, rods and other mechanical components (hidden from view) known in the art are disposed within the motor assembly 115. The mechanical components are configured to facilitate a transfer of power from the power source to the base 125.

A blade 135 is mounted to a first face of the base 125. The blade 135 is mounted substantially proximal to tip 125B of the base. The blade 135 can have any suitable shape or style, but not limited to, a razor, a serrated spay, a spear point, a wharncliffe, a trailing point, a pen, a talon, a straight back, a dagger, a drop point, a clip point, rounded, triangular, and combinations thereof Δny conventional and commercially available blade may be used. The blade may be made of stainless steel or any suitable material.

In certain embodiments, a safety cap/cover to substantially enclose the blade may be provided. For example, a magnetic safety cap may be provided to cover the blade and to allow the cap to remain in place more effectively. The safety cap can be configured to come to a substantially semi-sharp angle at its tip to be used to score a material (such as, paper, wood or another desired material).

Figure 2A:
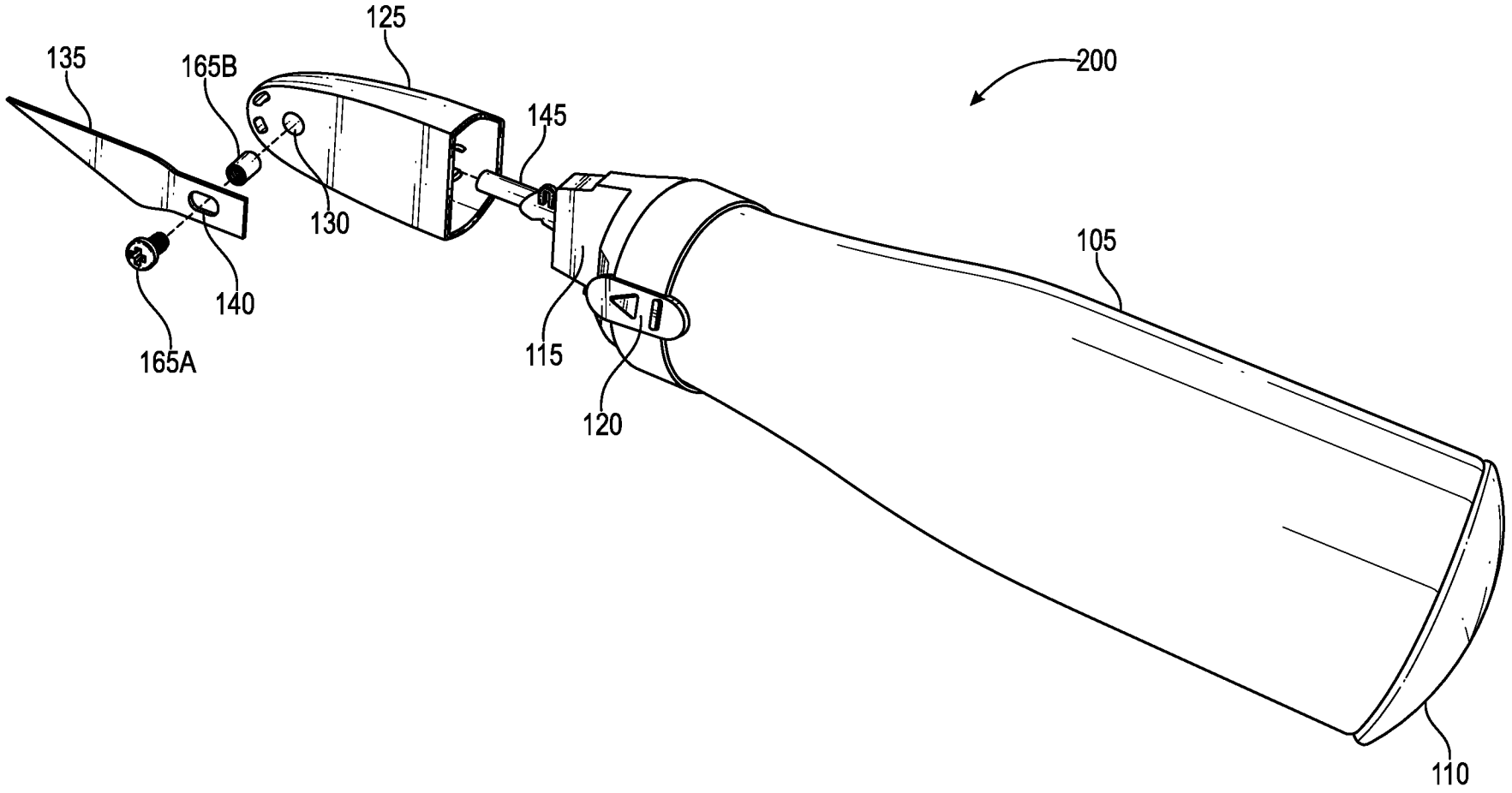
FIG. 2A illustrates another view of the electric utility knife according to an embodiment of the invention.

FIG. 2A depicts another perspective view 200 of the knife 100 wherein the blade is demounted from the base. As shown, the knife 100 comprises a shaft 105. The shaft 105 is encased at one end by cover 110. A motor assembly 115 is coupled to the second end of the shaft. The motor assembly includes a protruding tip 145. The knife 100 further includes a blade base 125.

Figure 2B:
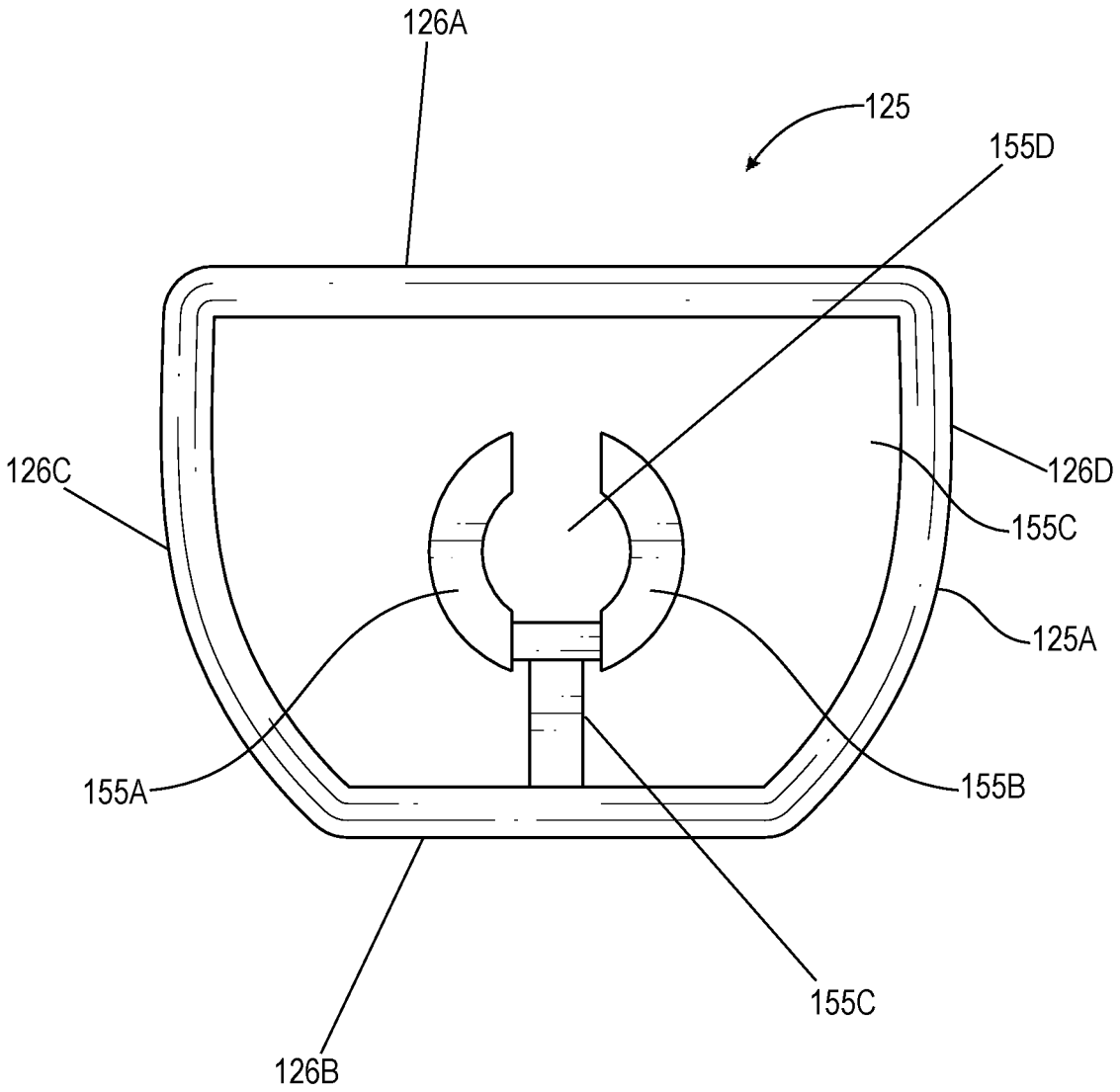
FIGS. 2B-2C depict blade bases according to an embodiment of the invention.

As shown in FIG. 2B, the blade base 125 includes a housing 125A. The housing 125A includes four sidewalls 126A, 126B, 126C and 126D. Sidewalls 126C and 126D are arcuate in shape. An internal chamber 155C is formed within the inside sidewalls of the housing 125A. A pair of flanges 155A, 155B can be molded into an inside surface of at least one of the sidewalls. The flange members 155A, 155B are semi-circular. A substantially T-shaped member 155C connects the two flange members 155A, 155B. The protruding tip 145 of the motor assembly 115 is configured to be held substantially securely within an aperture 155D formed between the pair of flanges 155A, 155B.

Blade 135 is coupled to the base 125 using a suitable fastener 165A, 165B (together "165"). A first face of the housing 125A includes an opening 130 for receiving the fastener 165. The fastener 165 can include any type of fastening mechanism, such as, but not limited to, screws, washers, nuts and combinations thereof.

Figure 2C:
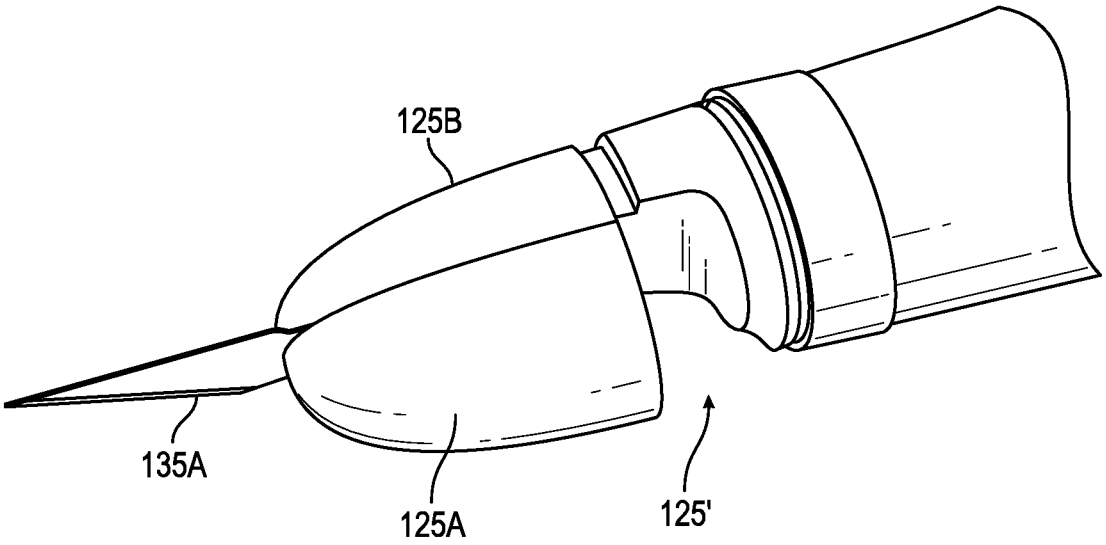
Figure 3A:
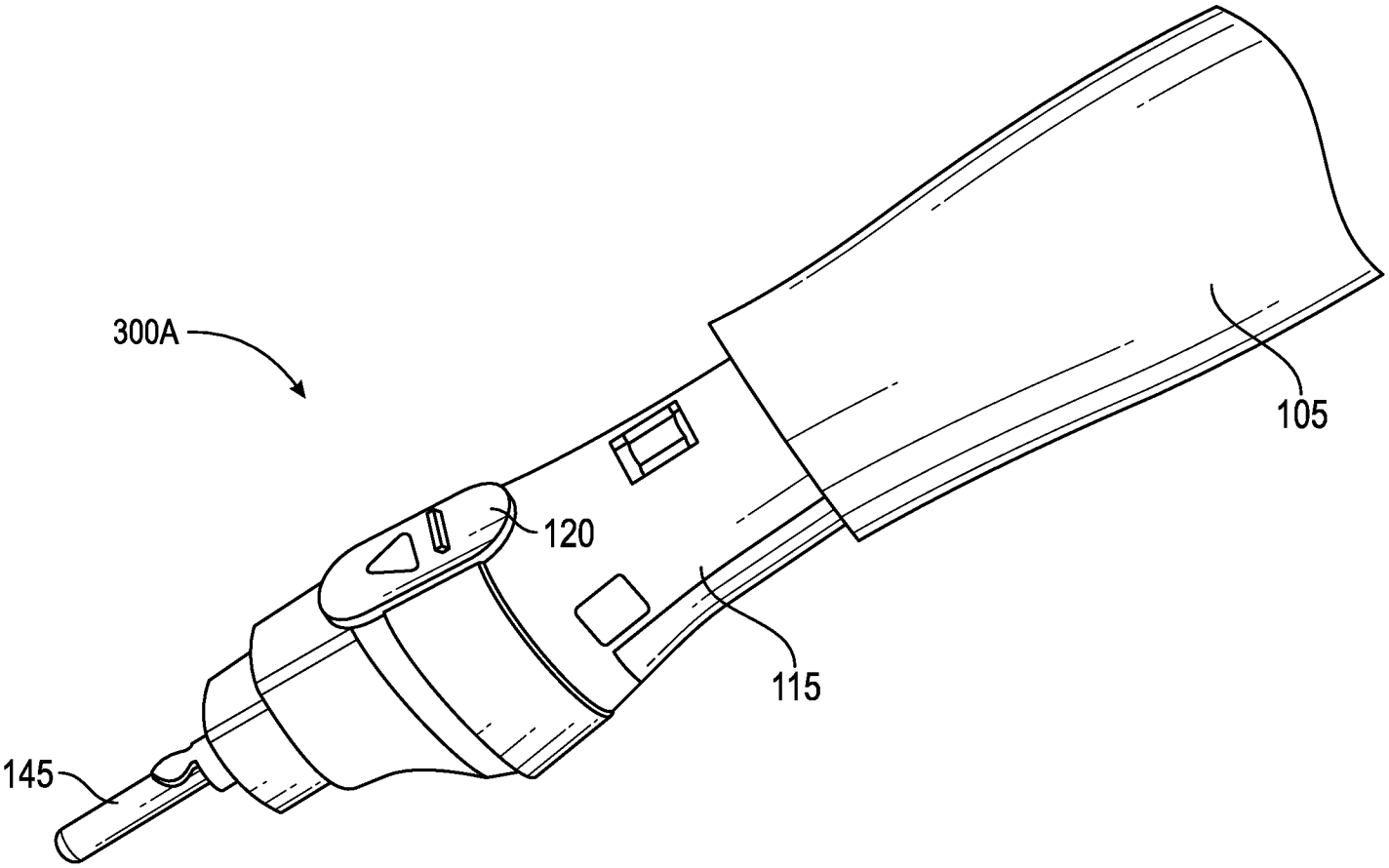
FIGS. 3A-3D illustrate views of the components of the electric utility knife according to an embodiment of the invention.
Figure 3B:
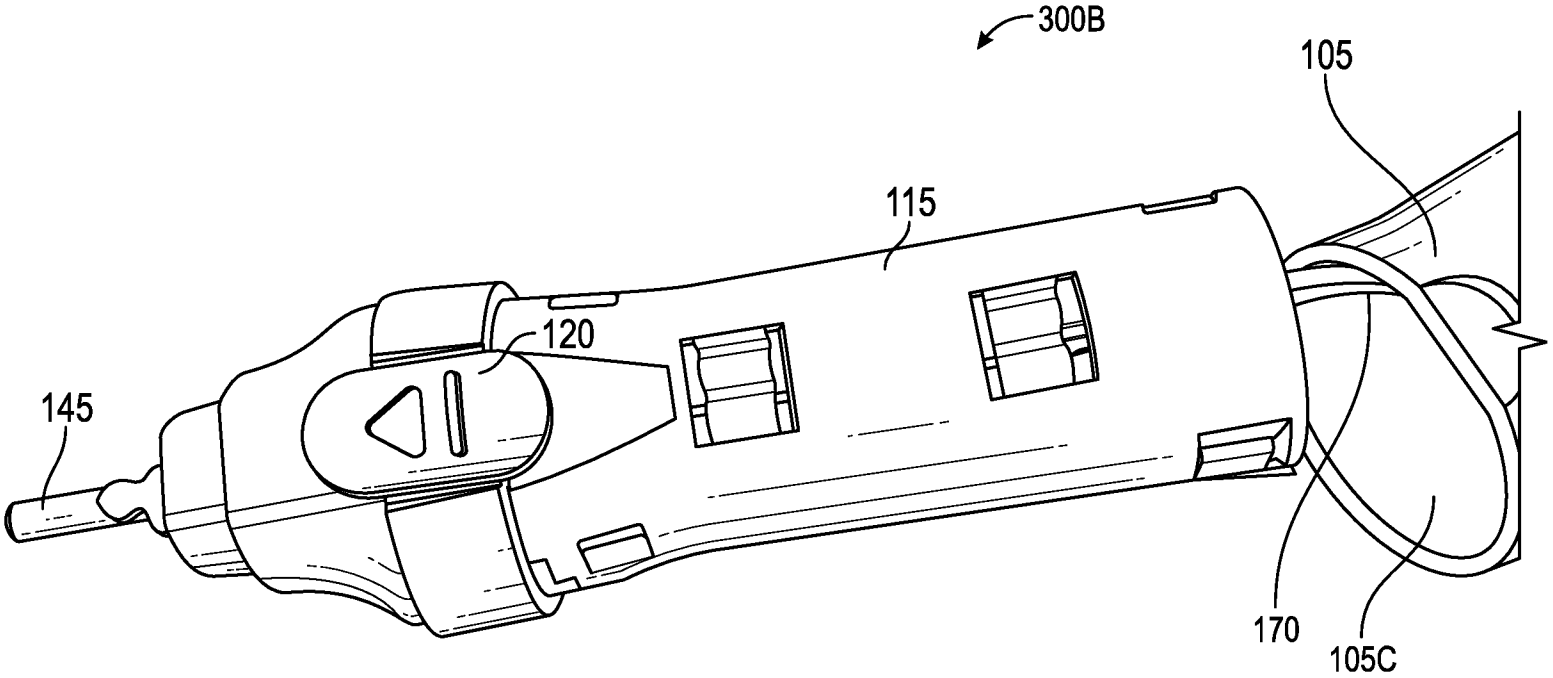
Figure 3C:
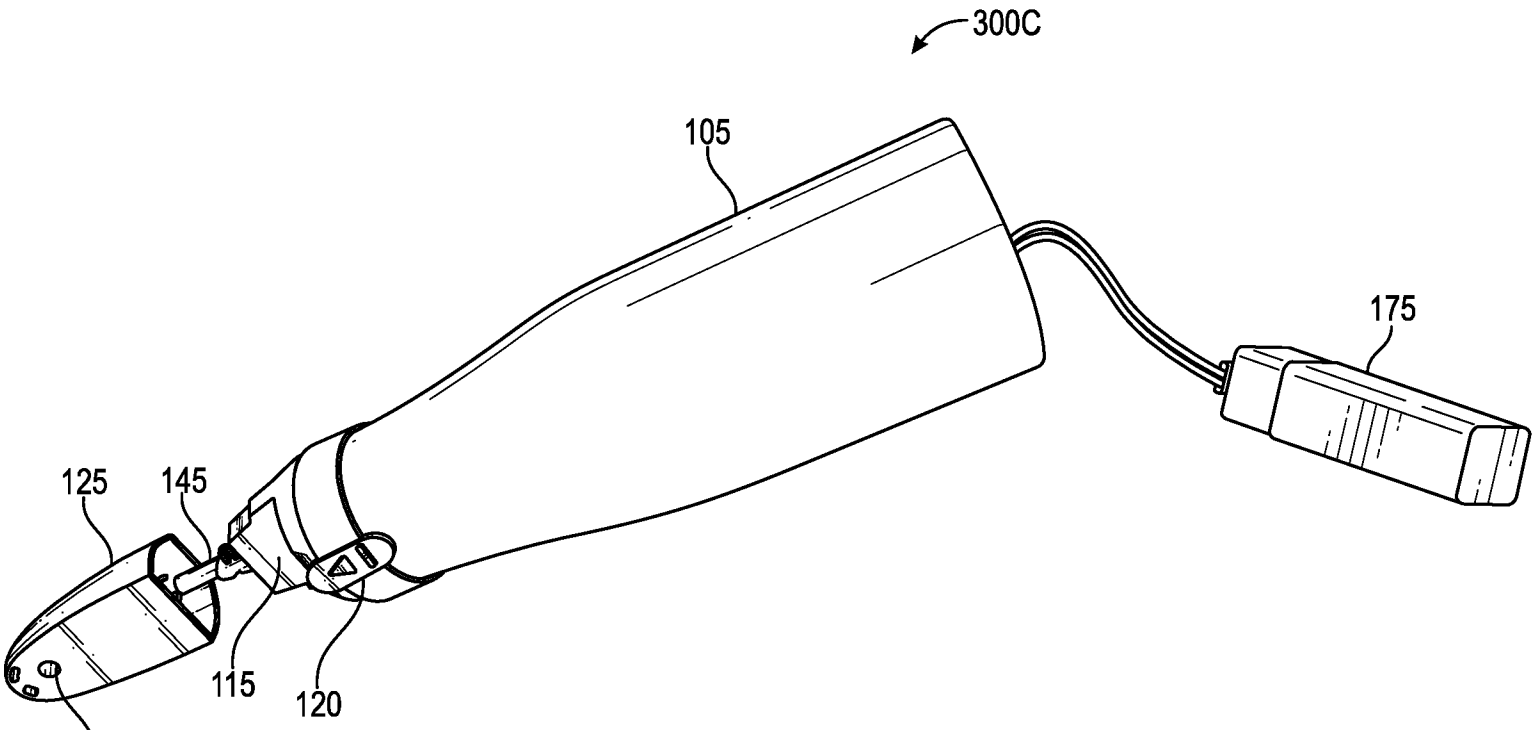
Figure 3D:
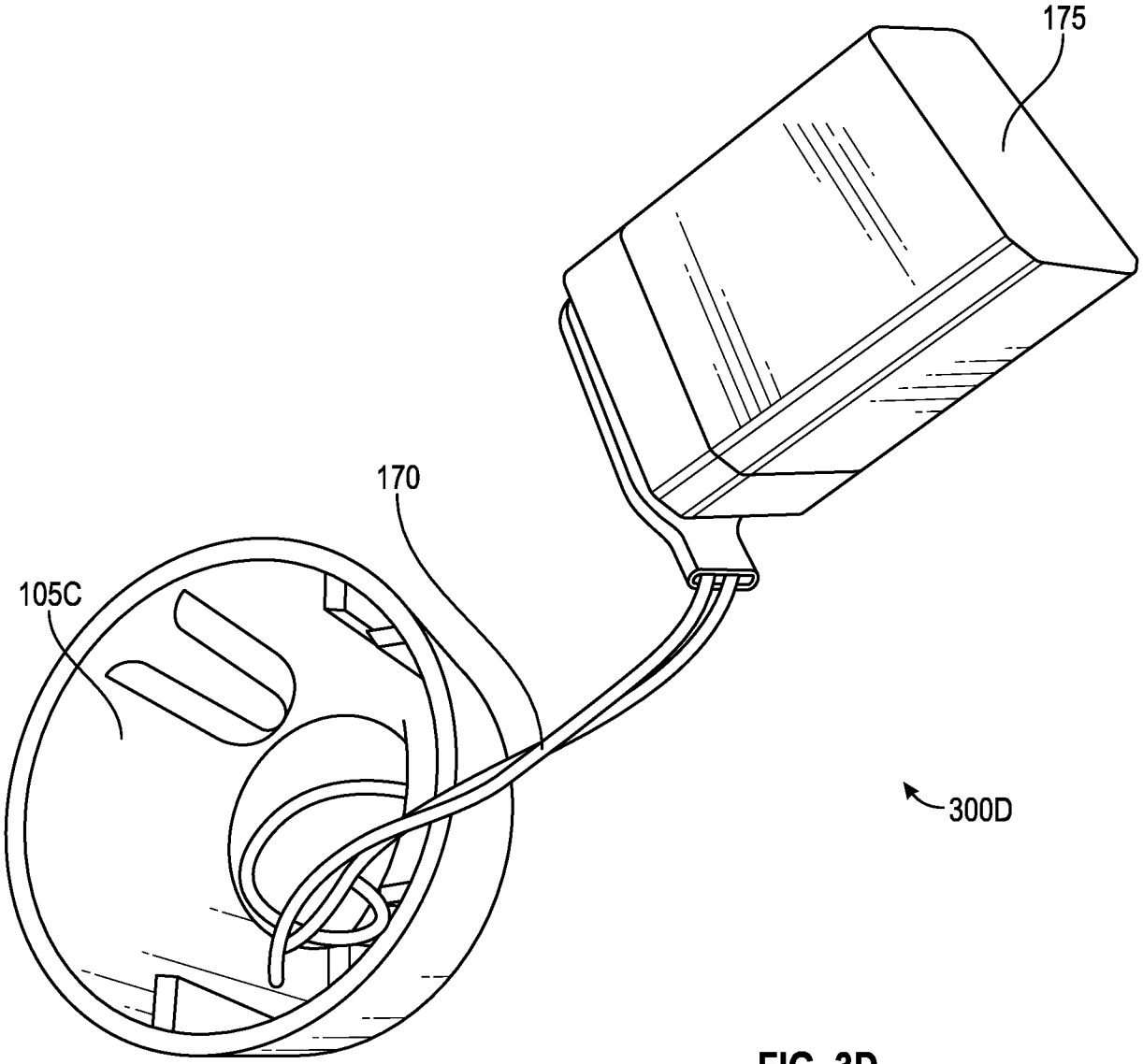

FIG. 2C depicts another embodiment 125' of the blade base. As shown in FIG. 2C, the blade 135A can be encased in a double base 125A, 125B. The blade 135A can be snapped into the slot created between the two bases 125A, 125B. In other embodiments, the blade securing base 125 may include a blade lock button (not shown) which can be pressed to lock the blade for secure use. In certain other embodiments, the blade 135 can be configured to be retracted within the housing of the base.

In one aspect, the blade 135 can be removed by, for example, unscrewing it from the base 125. The removable blade can be configured to be dishwasher-safe for fast and convenient cleanup. In certain embodiments, a blade release button (not shown) can be provided. The blade release button can be pressed to unlock the blade for easy removal.

FIGS. 3A-3D illustrate various views 300A-300D of the components of the knife 100. Motor assembly 115 is configured to be at least partially disposed within a cavity 105C formed inside shaft 105. As shown, the motor assembly 115 is a removable component that is separate from the shaft. However, in certain embodiments, the motor assembly 115 can be affixed to or integrated with the shaft to form a singular component. The motor assembly 115 is configured with a tip 145 at a first end. A power button 120 is provided on the motor assembly 115. The power button 120 is configured to switch the knife 100 between ON and OFF states. In certain embodiments, the button 120 can be further configured to start and end a desired physical motion, vary the speed and/or vary/switch between one or more physical motions. For instance, the button 120 can switch between vibration/oscillation/rotation of the blade at a singular consistent speed or at varying speeds. In certain embodiments, one or more other buttons may be provided to control the desired physical motion/speed, etc.

As shown, the power button 120 includes a moveable ridge 122 that can be moved from a first position to a second position in order to switch the knife ON or OFF. However, it is understood, that any other configuration for the power button, such as, depressible buttons, touch-buttons, etc. that are known in the art can be used instead. The tip 145 is configured to be secured within a blade base 125, as described previously. The cavity formed inside the shaft is also configured to house a removable power source 175. The power source can include one or more batteries. Commercially available batteries can be used as a power source. For instance, lithium batteries, non-rechargeable or rechargeable batteries may be used as the power source 175.

The power source 175 can be physically and electrically connected to the motor assembly 115 through connectors, such as, wires 170 and other components which can be configured to transfer power from the power source 175 to the motor assembly 115. The tip 145 of the motor assembly is in mechanical engagement with the base 125. The tip 145 can be configured to provide a desired physical motion, including vibration, oscillation, rotation and combinations thereof to the blade 135 when the knife is in the ON state.

In some embodiments, the power source 175 can be configured with a visual indicator, such as, an LED light (not shown) that can indicate whether the knife 100 is powered on.

In some embodiments, the shaft 105 can also be configured with a storage chamber (not shown) inside the cavity to hold therein one or additional blades.

Figure 4:
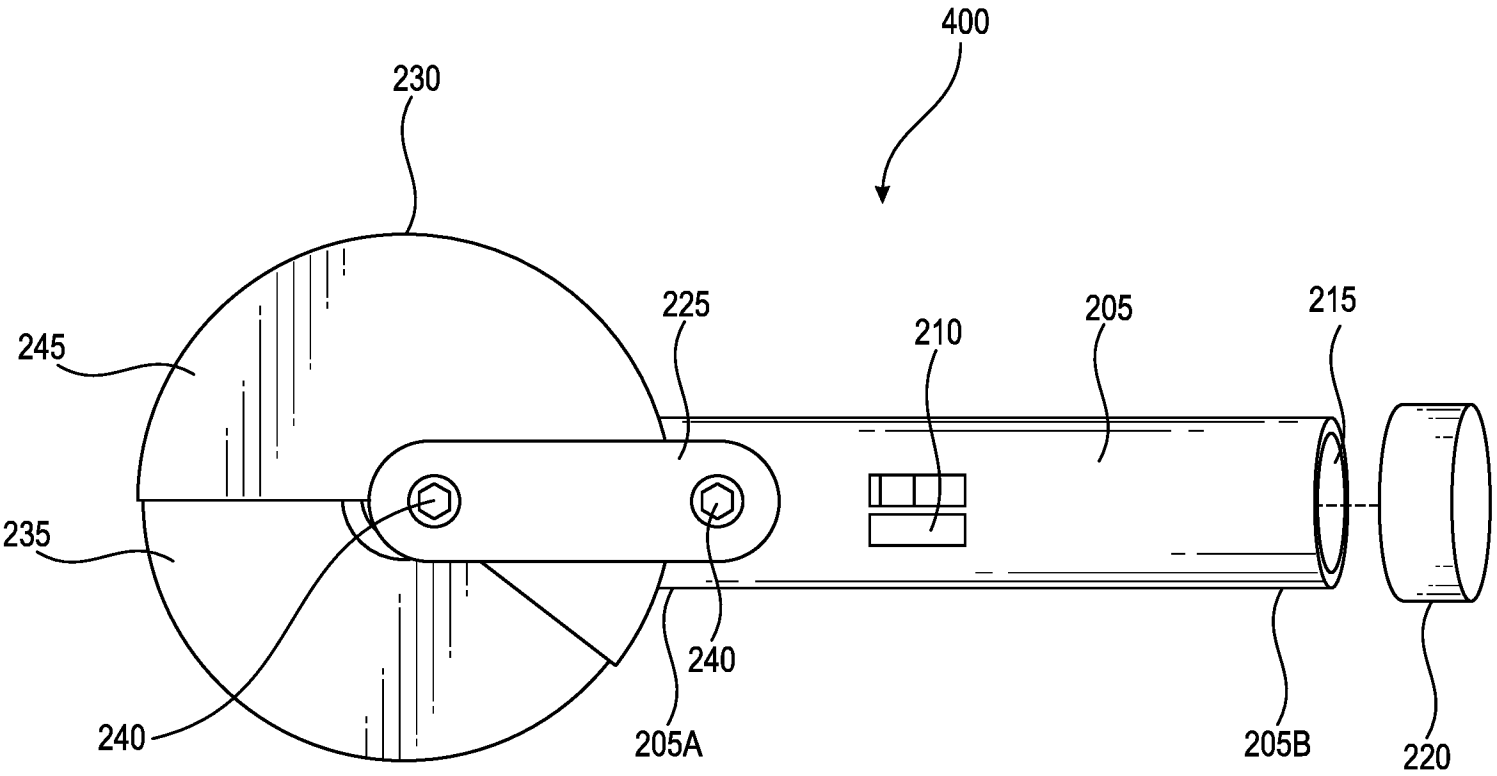
FIG. 4 illustrates an electric utility knife according to another embodiment of the invention.

Now referring to FIG. 4, another embodiment 400 of the electric utility knife is illustrated. In the interests of brevity, features of like components (such as the shaft, blade, etc.) are not elaborated in this and the other subsequent embodiments. The knife 400 includes an elongated cylindrical shaft 205. A first end of the shaft 205A includes at least one arm 225 that radially extends from the shaft 205. The arm 225 may be secured to the shaft 205 with one or more suitable fasteners 240. The fastener 240 may be substantially any type of fastening device, such as, but not limited to, a screw, washer and nut, or the like. The shaft 205 can include an on/off power button 210.

The arm 225 is configured to securely hold a suitable blade 235. As shown, the blade has a rounded shape. However, as described earlier, the blade 235 can have any suitable shape or style. The blade 235 can be provided with a suitable corresponding sleeve or cover 230. The cover 230 can cushion the user's hand/fingers and facilitate an ergonomic grip. The cover 230 and blade 235 may also be provided with a suitable fastener 245.

A shaft 205 can include a cavity 215. The cavity 215 is configured to accommodate one or more batteries (not shown). The shaft 205 is further provided with a corresponding battery cover 220.

Figure 5:
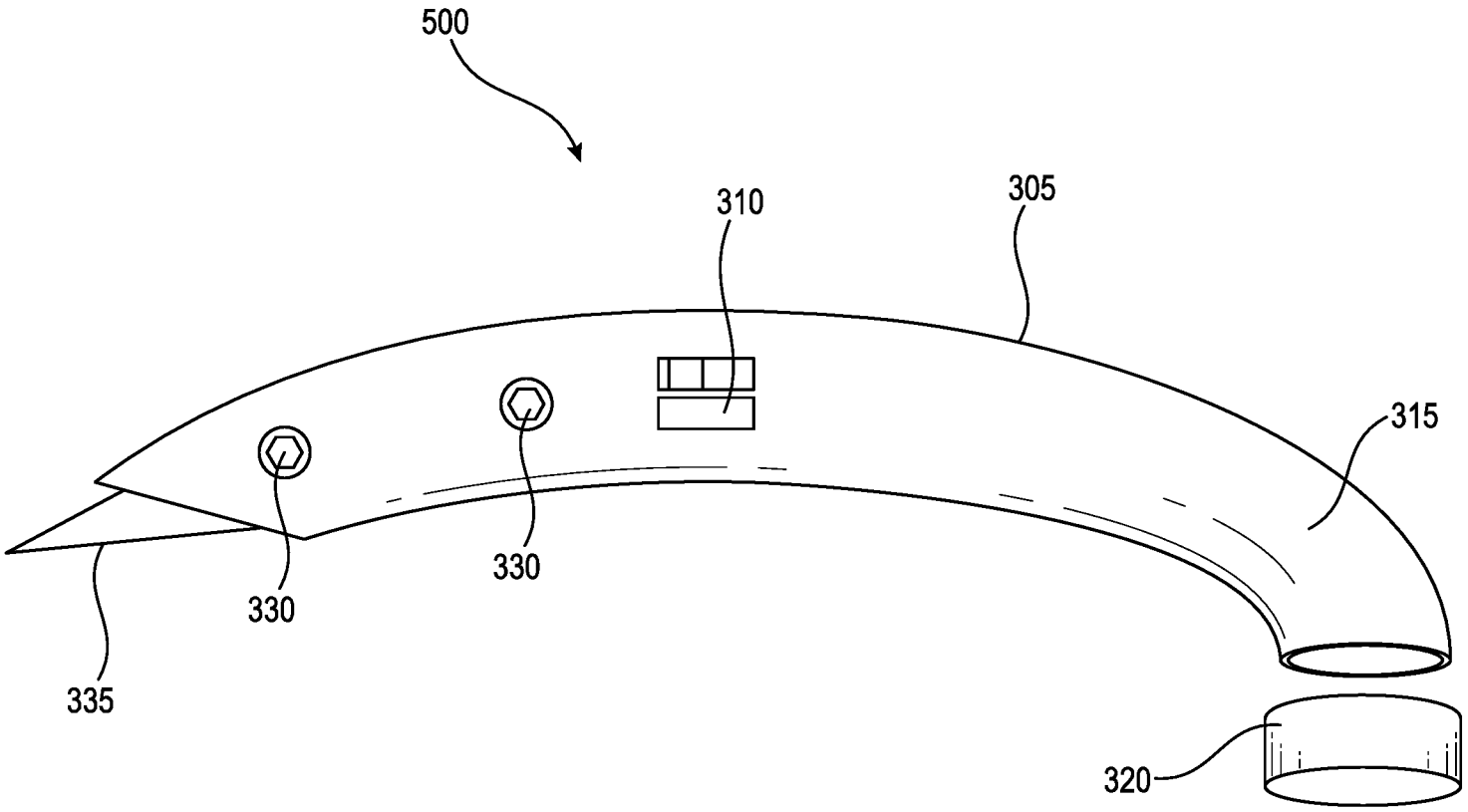
FIG. 5 illustrates an electric utility knife according to yet another embodiment of the invention.

Now referring to FIG. 5, a third embodiment 500 of the electric utility knife is illustrated. The knife 500 includes a substantially arcuate cylindrical shaft 305. The shaft 305 has an on/off power button 310. A first end of the shaft 305 is configured to receive a blade 335. The blade 335 can have any suitable shape or style. The blade 305 is secured to the shaft 305 using one or more fasteners 330. The fastener 330 may be substantially any type of fastening device, but not limited to, a screw, nuts, washers or the like. A second end of the shaft 305 can include a battery compartment 315. The battery compartment 315 can accommodate one or more batteries (not shown). The battery compartment 315 is provided with a corresponding battery cover 320.

In certain embodiments, a kit containing an electric utility knife according to one or more embodiments discussed herein and/or one or more blades can be provided. The kit can also include one or more batteries for the knife. The kit can further include a suitable paper, plastic or other housing for the knife and/or blades. The kit can include instructions for using the knife and placement/replacement of the blade. In yet another embodiment, the kit can include a holster/holder for the knife. The kit can further include a pocket protector/carrier for the knife. The holster can be worn on a belt or attached/clipped on to a backpack, bag or purse. In certain embodiments, warehouse workers or handymen can conveniently carry the knife in the holster at work so that they do not have to waste time constantly searching for it or having to worry about their knife taken from a toolbox, for example, by someone else and not returned.

One or more components/parts of the knife, including the shaft, motor assembly and blade base can be made of plastic, metal, polymer, silicon and other suitable materials. Preferably, the components of the knife described above can be interchangeably arranged—for example, plastic/metal/silicon components can be connected to each other—as needed, to substantially reduce unnecessary friction or to facilitate less friction between the moving parts.

A magnet can be built into the shaft to allow the knife to be securely stored in any position—for instance, vertically, horizontally, hanging, etc.—on a metallic counter or surface.

An opening or hole (not shown) may be provided on the battery cover or proximal to the second end of the shaft to allow the knife to be conveniently hung for storage, by attaching it to a coupling link, such as, a carbiner or other similar mechanisms.

The knife may be rechargeable. In one aspect, the knife may be conveniently configured as a cordless and rechargeable knife. The motor assembly can be powered by one or more batteries (such as lithium batteries). The knife can be configured to operate for 15-60 minutes on a single charge.

In an embodiment, a method of using the knife according to one or more embodiments is disclosed. The method involves providing a knife according to an embodiment disclosed herein. The method further involves inserting a power source (such as, a 9V battery) inside the shaft. This is followed by removing a protective blade cap (if provided). The blade is then secured to the base using a fastener (such as, a screw and washer) or by snapping the blade in place inside a slot. Once the blade is secured in place, the knife is powered on. In certain embodiments, a desired physical motion can be then selected. For example, the user can select between vibration, oscillation or rotation motions. Once the blade is in motion, the user can grip the knife using the shaft and safely and precisely begin to cut a desired and appropriate material. The user may simply guide the blade by exerting minimal manual pressure on the knife. After the cutting is completed, the user can turn the power button into an OFF state. The blade cover can be attached to the blade for safety and the blade can then be safely secured away.

The embodiments of the current invention can be used by anybody who requires precision cutting for work or leisure. For instance, the knife having a desired configuration can be used in for medical/surgical use in hospitals and in a medical office, architecture and drafting, engineering, food service, apparel, furniture, art, logistics, automotive, textile and virtually any other industry which needs a device for precise cutting for a variety of applications. The knife can also be used by scrap bookers, crafters, sewers, tailors, home do-it yourselfers, plumbers, mechanics.

The knife may be sold wherever traditional manual utility knives are sold as well as wherever food service and medical goods are sold, for example, small and big box hardware and home improvement stores, small and big box craft stores, small and big box restaurant/home cooking supply stores, online purchase portals, tactical supply stores, small and big box medical supply stores, drug stores, big box discount stores and other such stores.

No limitation with regard to the described aspects or embodiments of the present invention is intended. Many modifications to the depicted embodiments may be made without departing from the spirit and scope of the present invention. Accordingly, the foregoing description is intended to be illustrative rather than restrictive. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure.

While the knife and methods are described in terms of "comprising," "containing," or "including" various components or steps, they can also "consist essentially of" or "consist of" the various components and steps. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

The invention claimed is:

1. An electric utility knife, comprising:

an elongate shaft, the shaft configured to be hand-held during a cutting operation, the shaft comprising an internal cavity;

a motor assembly, wherein at least a portion of the motor assembly is positioned within the cavity, and wherein the motor assembly includes a protruding tip;

a blade base in mechanical engagement with the motor assembly, wherein the blade base includes:

a housing, wherein the housing comprises four sidewalls, and wherein the housing encloses:

a pair of flanges molded to an inside surface of at least one of the sidewalls, the pair of flanges comprising:

a first semi-circular flange member; and a second semi-circular flange member, wherein the second semi-circular flange member is located opposite the first semi-circular flange member, and a substantially T-shaped member, wherein the T-shaped member connects the first and the second semi-circular flange members, wherein an aperture is formed between the first and second semi-circular flange members, wherein the aperture is configured for receiving and securing the protruding tip of the motor assembly; and a blade coupled to a first face of the blade base.

2. The electric utility knife according to claim 1, wherein the shaft is cylindrical and tapers from a first end to a second end, wherein the first end is opposite the second end.

3. The electric utility knife according to claim 1, further comprising a removable power source, wherein the power source is disposed within the cavity.

4. The electric utility knife according to claim 3, wherein the electric utility knife is configured to facilitate manual precision cutting at either a singular consistent speed or at variable speeds.

5. The electric utility knife according to claim 1, further comprising a cover for enclosing one end of the shaft.

6. The electric utility knife according to claim 1, wherein the motor assembly comprises a power button, the power button configured to switch the electric utility knife between and ON and OFF state.

7. The electric utility knife according to claim 1, further comprising a safety cover for the blade.

8. The electric utility knife according to claim 1, wherein the housing includes at least a pair of sidewalls having an arcuate shape.

9. A method for cutting a material, comprising:

providing an electric utility knife, comprising:

an elongate shaft, the shaft configured to be hand-held during a cutting operation, the shaft comprising an internal cavity;

a motor assembly, wherein at least a portion of the motor assembly is positioned within the cavity, and wherein the motor assembly includes a protruding tip;

a blade base in mechanical engagement with the motor assembly, wherein the blade base includes:

a housing, wherein the housing comprises four sidewalls, and wherein the housing encloses:

a pair of flanges molded to an inside surface of at least one of the sidewalls, the pair of flanges comprising:

a first semi-circular flange member; and a second semi-circular flange member, wherein the second semi-circular flange member is located opposite the first semi-circular flange member, and a substantially T-shaped member, wherein the T-shaped member connects the first and the second semi-circular flange members, wherein an aperture is formed between the first and second semi-circular flange members, wherein the aperture is configured for receiving and securing the protruding tip of the motor assembly; and a blade coupled to a first face of the blade base.

10. The method according to claim 9, further comprising inserting a power source inside the shaft.

11. The method according to claim 10, wherein the shaft is configured to be gripped by a user.

12. The method according to claim 11, further comprising switching the power source to an ON state and guiding the blade to cut the material.

13. The method according to claim 12, wherein the electric utility knife is configured to facilitate manual precision cutting at either a singular consistent speed or at variable speeds.

14. An electric utility knife kit, comprising:

a cordless electric utility knife, the electric utility knife comprising:

an elongate shaft, the shaft configured to be hand-held during a cutting operation, the shaft comprising an internal cavity;

a motor assembly, wherein at least a portion of the motor assembly is positioned within the cavity, and wherein the motor assembly includes a protruding tip; and a blade base in mechanical engagement with the motor assembly, assembly, wherein the blade base includes:

a housing, wherein the housing comprises four sidewalls, and wherein the housing encloses:

a pair of flanges molded to an inside surface of at least one of the sidewalls, the pair of flanges comprising:

a first semi-circular flange member; and a second semi-circular flange member, wherein the second semi-circular flange member is located opposite the first semi-circular flange member, and a substantially T-shaped member, wherein the T-shaped member connects the first and the second semi-circular flange members, wherein an aperture is formed between the first and second semi-circular flange members, wherein the aperture is configured for receiving and securing the protruding tip of the motor assembly; and one or more blades, the blades configured to be coupled to a first face of the blade base.

* * * * *